United States Patent [19]

Masho et al.

[11] Patent Number: 4,705,154

[45] Date of Patent: Nov. 10, 1987

[54] COIN SELECTION APPARATUS

[75] Inventors: Yukio Masho, Hashima; Shigeru Kakimi, Inazawa; Toru Ueki; Satoshi Miyauchi, both of Gifu; Tugio Ohigashi, Aichi; Hitoshi Kurohata, Komaki, all of Japan

[73] Assignee: Matsushita Electric Industrial Co. Ltd., Osaka, Japan

[21] Appl. No.: 779,122

[22] Filed: Sep. 23, 1985

[30] Foreign Application Priority Data

May 17, 1985 [JP] Japan ..... 60-105003
May 17, 1985 [JP] Japan ..... 60-105004
May 17, 1985 [JP] Japan ..... 60-105005

[51] Int. Cl.[4] ..... G07F 3/02

[52] U.S. Cl. ..... 194/319; 194/318; 194/334; 194/335

[58] Field of Search ..... 194/303, 317, 318, 319, 194/320, 334, 335, 321, 322, 323, 324, 325, 326

[56] References Cited

U.S. PATENT DOCUMENTS

| | | | |
|---|---|---|---|
| 2,540,063 | 1/1957 | Victoreen | 194/318 |
| 3,059,749 | 10/1962 | Zinke | 194/321 X |
| 3,587,809 | 6/1971 | Meloni | 194/319 |
| 3,738,469 | 6/1973 | Prümm | 194/318 |
| 4,091,908 | 5/1978 | Hayashi et al. | 194/318 |
| 4,108,296 | 8/1978 | Hayashi et al. | 194/318 |
| 4,124,111 | 11/1978 | Hayashi | 194/319 X |
| 4,206,775 | 6/1980 | Tanaka | 194/319 X |
| 4,234,071 | 11/1980 | Le-Hong | 194/317 |
| 4,286,704 | 9/1987 | Wood | 194/318 |
| 4,323,148 | 4/1982 | Nichimoto et al. | 194/321 |
| 4,326,621 | 4/1982 | Davies | 194/319 |
| 4,353,453 | 10/1982 | Partin et al. | 194/319 |
| 4,371,073 | 2/1983 | Dubey | 194/334 |
| 4,436,196 | 3/1984 | Crisp et al. | 194/318 |
| 4,437,558 | 3/1984 | Nicholson et al. | 194/325 |
| 4,469,213 | 9/1984 | Nicholson et al. | 194/320 |
| 4,574,936 | 3/1986 | Klinger | 194/318 |

FOREIGN PATENT DOCUMENTS

| | | |
|---|---|---|
| 54739/80 | 8/1980 | Australia . |
| 81133/82 | 9/1982 | Australia . |
| 11182 | 3/1981 | Japan . |
| 6985 | 2/1983 | Japan . |
| 30632 | 6/1983 | Japan . |

*Primary Examiner*—Robert J. Spar
*Assistant Examiner*—P. McCoy Smith
*Attorney, Agent, or Firm*—Spencer & Frank

[57] ABSTRACT

A coin selection apparatus comprises a plurality of detection coils and an oscillation circuit which detects changes of impedances of the detection coils caused when a coin pass through the detection coils, as a change of a voltage output. The plurality of detection coils include at least two sets of detection coils each including two detection coils opposingly arranged to the coin path. One set of detection coils has its two coils connected in series and in phase and the other set of detection coil has its two coils connected in series and in phase opposition. The two sets of coils are arranged at a spacing along the coin path smaller than a minimum diameter of a coin to be selected and all of the coils are connected in series and connected as a resonance element of the oscillation circuit. Thus, material, thickness and diameter and other appearance characteristic of the coin are detected based on the voltage output of the oscillation circuit. Accordingly, the coin selection apparatus is of simple construction and has a small number of components.

7 Claims, 18 Drawing Figures

COIN SELECTION APPARATUS

BACKGROUND OF THE INVENTION

The present invention relates to a coin selection apparatus used in an automatic vending machine or a money changing machine.

Various coin selection apparatus have been proposed. In one electronic coin selection apparatus, at least two detection coils are arranged in a path of coins and changes of impedances of the detection coils caused when a coin passes therethrough under an influence of electromagnetic fields by the detection coils are detected.

The selection system of the apparatus of this type includes a frequency change detection system in which the detection coils are used as oscillation coils and the changes of equivalent inductances caused when the coin passes therethrough are detected as changes of oscillation frequencies, an impedance voltage detection system in which the detection coils are used as oscillation coils and changes of equivalent loss resistances R caused when the coin passes therethrough are detected as changes of resonance circuit impedances, and a system in which a bridge circuit is constructed by the detection coil, a standard impedance element and two other impedance elements and a balance point of the bridge when the coin passes therethrough is detected.

In the coin selection, in order to enhance the selection accuracy including the selection of denomination of the coin and ejection of false coins, the above selection systems are combined, or in a single selection system, a plurality of frequencies are set for electromagnetic fields by the detection coils.

FIG. 8 shows a configuration of a prior art frequency change detection system. Three detection coils 201, 202 and 203 arranged in a coin path detect shape, thickness and material of a coin, respectively.

The detection coils 201, 202 and 203 are constructed as oscillation coils of oscillation circuits 204, 205 and 206 having independent oscillation frequencies. Numeral 207 denotes an AND circuit, and numeral 208 denotes a counter. The oscillation frequencies of the oscillation circuits 204, 205 and 206 are sequentially read by strobe signals $S_1$, $S_2$ and $S_3$ from a microcomputer 209 and coins are selected by examining the read data by executing a coin selection program in the microcomputer 209. (See Japanese Examined Patent Publication No. 58-6985). In FIG. 8, $IN_A$ and $IN_B$ denote counter input ports.

FIG. 9 shows a configuration of a prior art bridge balance point detection system. An oscillation coil 351 is excited by an A.C. power supply 350 of a constant voltage and supplies constant voltages to two receiving coils 352 and 353. Numeral 310A denotes a detection coil for detecting material and thickness of a coin, and numeral 310B denotes a detection coil for detecting a shape of the coin. The detection coil 310A forms bridge circuits 311A–314A one for each denomination of coin and each including the detection coil 310A in one side of the bridge. Outputs of the bridge circuits are supplied to differential amplifiers 301A–304A, respectively, and outputs thereof are supplied to comparators 305A–308A, respectively. Outputs of the comparators 305A–308A are supplied to a discrimination circuit 309. The detection coil 310B is similarly configured to the detection coil 310A and connected to the discrimination circuit 309.

An output of the A.C. power supply of the bridge circuits is supplied to the discrimination circuit 309 through a waveform conversion circuit 310.

The discrimination circuit 309 supplies a reference pulse train to a clock pulse input port CP and output levels from the comparators 305A–308A and 305B–308B and compares them with a predetermined reference to select the coin. (See Japanese Examined Patent Publication No. 58-30632).

In FIG. 9, L1A–L4A and R1A–R4A are variable inductors and variable resistors which form standard impedance elements for denominations of coins of the bridge circuits 311A–314A including the detection coil 310A, $Y_{0A}$–$Y_{4A}$ are one-side impedances of the bridge circuits 311A–314A, and $L_{1B}$–$L_{4B}$, $R_{1B}$–$R_{4B}$ and $Y_{0B}$–$Y_{4B}$ are variable inductors, variable resistors and impedances of the bridge circuits 311B–314B. $IN_{1A}$–$IN_{4A}$ and $IN_{1B}$–$IN_{4B}$ denote input ports.

FIG. 10 shows a configuration of a prior art impedance voltage detection system. Numeral 901 denotes a detection coil arranged in a coin path to detect a material of a coin, numerals 902 and 903 denotes detection coils for detecting a thickness of the coin and numeral 904 denotes a detection coil for detecting a diameter of the coin. The coils 901–904 form a portion of an oscillation circuit OSC. Changes of impedances of the coils 901–904 are outputted as a frequency change of the oscillation circuit OSC and the frequency change is converted to a voltage by a frequency-voltage conversion circuit FVC, an output of which is supplied to material, thickness and diameter discrimination circuits M, T and D. The discrimination circuits M, T and D compare the detection outputs with predetermined references for each denomination of coin to select the coin. Numerals 905, 906 and 907 denote sensors arranged near the detection coils 901, 902 and 903, respectively, for detecting passage of the coin through the detection coils. The discrimination circuits M, T and D are set and reset by the signals of the sensors 905, 906 and 907. (See Japanese Examined Utility Model Publication No. 56-11182). $A_1$–$A_4$ denote AND gates which produce outputs when coins A, B, C and D are discriminated, respectively, and $A_5$ denotes an AND gate which produces a false coin output when a coin does not correspond to any of the coins A, B, C and D. The AND gate $A_5$ produces the output when NO signals are supplied from the discrimination circuits M, T and D. $DT_1$ and $DT_2$ denote first and second differentiation circuits which output signals in response to the detection signals of the passage deteotion sensors 905 and 907. A flip-flop FF is set and reset by those signals.

In the prior art selection apparatus shown in FIG. 8, a plurality of independent oscillation circuits are provided one for each of test items of the coin (size, material and thickness) and they are operated at the frequencies suitable for the respective tests. As a result, the flows of signals in the detection system is complex and the circuit configuration is complex. Further, wiring cables for the detection coils must be shielded in order to prevent interference of the signals in the oscillation circuits.

In the circuit of FIG. 9, two-side bridge impedance elements, differential amplifier and comparator are required for one detection coil for each denomination of coin. Thus, the signal flows in the detection system is complex and a number of circuit components are required. Further, adjustment for balancing the bridge for each denomination of coin is required.

In the circuit of FIG. 10, the detection coils are connected in series and the detection circuit including the oscillation circuits is simplified. However, the independent detection coils are required one for each of the test items of the coin (size, material and thickness), and the coin passage sensor and the detection circuit are required for each detection coil. Accordingly, the number of circuit components increases and the circuit configuration is complex.

The prior art selection apparatus are thus complex in the circuit configuration and require a large number of components. Accordingly, the cost increases, chance of occurrence of trouble is high and serviceability is low because the signals in the detection system are complex.

In a coin changer or an automatic vending machine which incorporates the coin selection apparatus, a demand to reduce the size of the apparatus has been increasing. The prior art apparatus cannot satisfy such demand.

SUMMARY OF THE INVENTION

It is an object of the present invention to provide a coin selection apparatus comprising a coin path along which a coin is fed, detection coils arranged along the coin path and a detection circuit for detecting changes of impedances of the detection coils caused when the coin passes therethrough. The detection coils each include two coils arranged oppositely to the coin path, and at least two sets of such detection coils are provided. All detection coils, including the two opposing sets of detection coils, are connected in series. By this arrangement, three factors of the coin (size, material and thickness) and an appearance difference from a reference coin are checked and the coin is accurately selected with a very simple configuration and a small number of components.

BRIEF DESCRIPTION OF THE DRAWINGS

The present invention will be apparent from the following detailed description taken in conjunction with the accompanying drawings, in which.

DETAILED DESCRIPTION OF THE PREFERRED EMBODIMENT

Figure 2A:
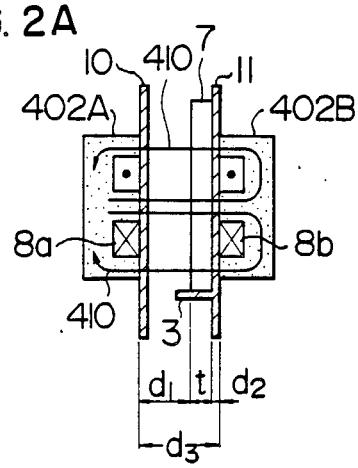
FIGS. 2A and 2B are sectional views showing a structure of a detection coil and a positional relationship of a thrown-in coin.
Figure 2B:
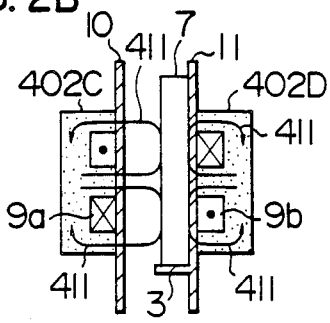
Figure 3:
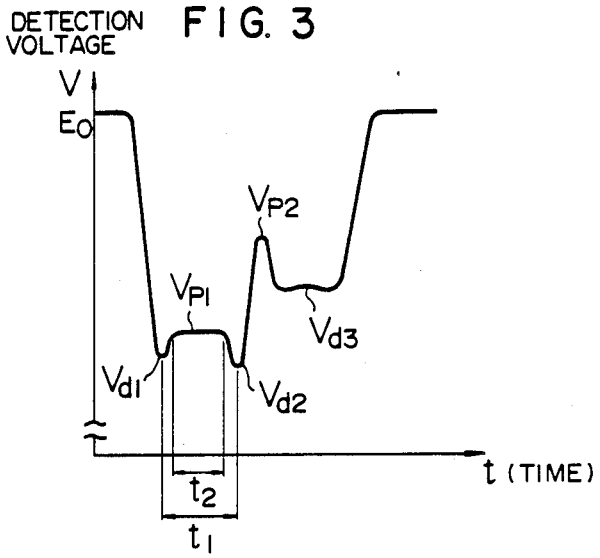
FIG. 3 shows an output voltage waveform of a detection circuit.
Figure 4A:
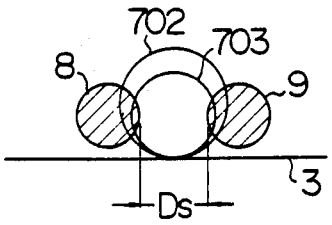
FIG. 4A illustrates setting positions of two detection coils with respect to the thrown-in coin.
Figure 4B:
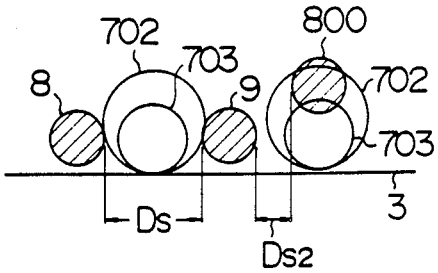
FIG. 4B illustrates setting positions of three detection coils with respect to the thrown-in coin.
Figure 5:
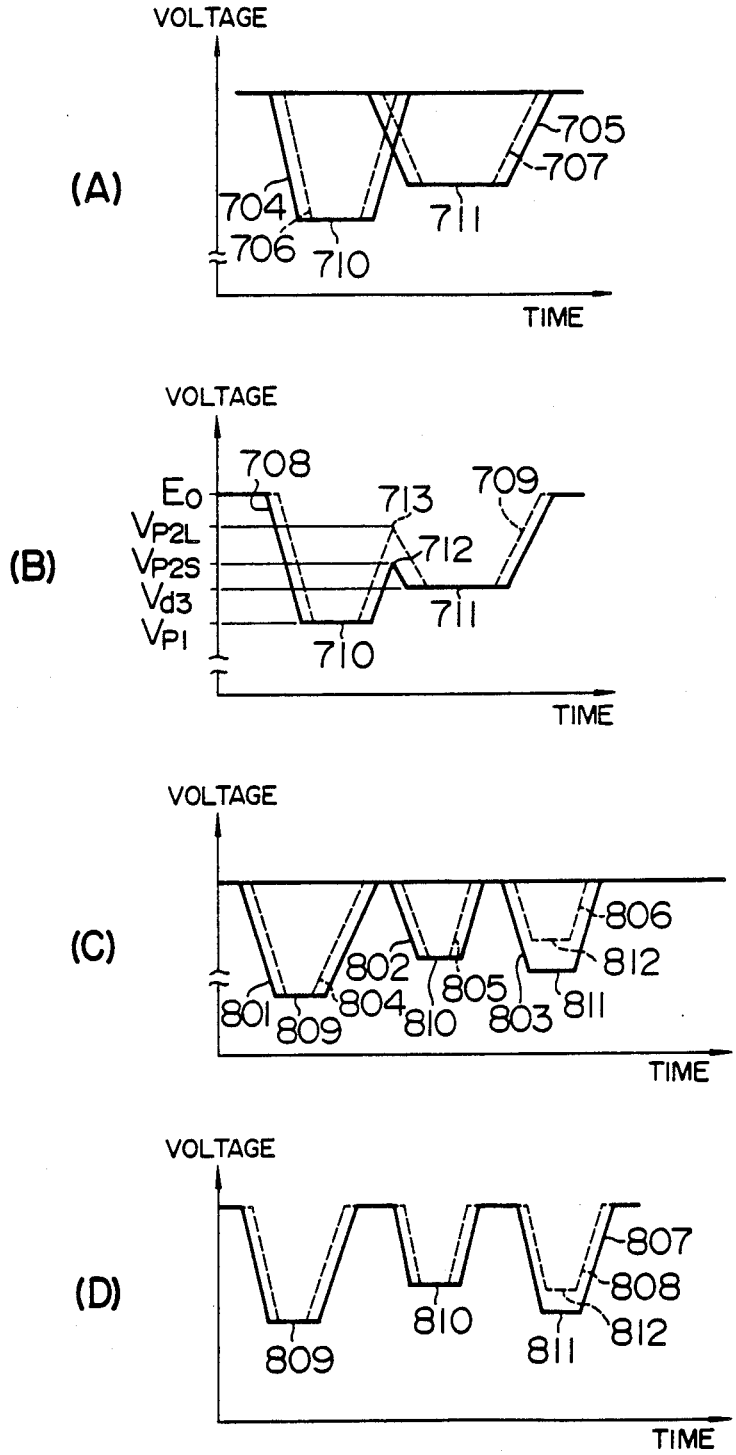
FIGS. 5(A) and 5(B) show waveforms of detection outputs of the detection coils of FIG. 4A.
FIGS. 5(C) and 5(D) show waveforms of detection outputs of the detection coils of FIG. 4B.

FIGS. 1, 2 and 4 show one embodiment of the present invention, and FIGS. 3, 5 and 6 show representative characteristics. In FIGS. 2 and 4, the like numerals to those shown in FIG. 1 designate the like elements.

Figure 1A:
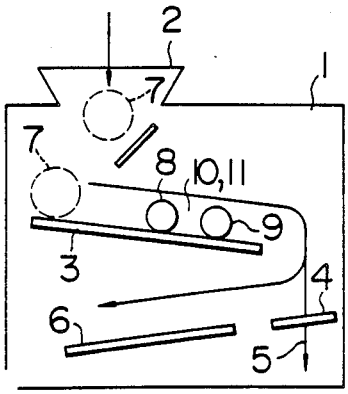
FIG. 1A is a front view of a main portion of one embodiment of a coin selection apparatus of the present invention.
Figure 1B:
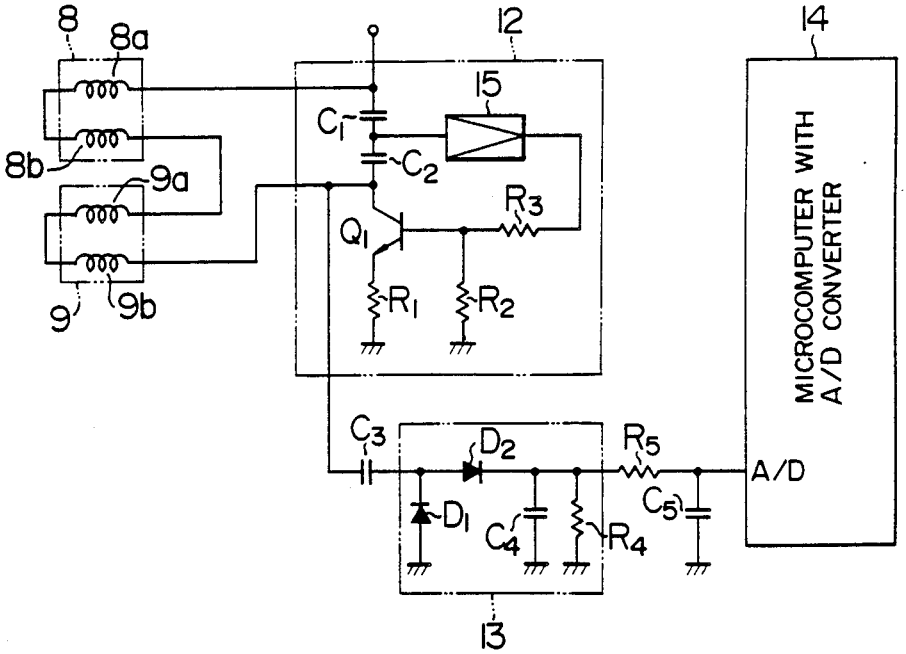
FIG. 1B is a circuit diagram of the apparatus of FIG. 1.

FIG. 1A shows a main portion of the coin selection apparatus and FIG. 1B shows a circuit configuration.

In FIG. 1, a coin 7 thrown in from a port 2 of a coin selection apparatus 1 rolls down a graded ramp 3 and passes by a detection coil or sensor 8 and a detection coil or sensor 9, and if the coin 7 is determined to be a true coin by the detection coils 8 and 9, a gate 4 is opened and the coin 7 is fed to a true coin path 5. If the coin 7 is determined to be a false coin, the gate 4 is not opened and the coin 7 is returned through a false coin path 6.

The first detection coil 8 and the second detection coil 9 have coils 8*a* and 8*b*, and coils 9*a* and 9*b*, respectively, which are connected in series as shown in FIG. 1B and form a resonance circuit with capacitors $C_1$ and $C_2$. The resonance circuit and a feedback amplifier 15, base resistors $R_2$ and $R_3$, an emitter feedback resistor $R_1$ and a transistor $Q_1$ form an oscillation circuit 12. The oscillation circuit 12 normally oscillates at a constant frequency determined by a series equivalent inductance of the detection coils 8 and 9 and the capacitors $C_1$ and $C_2$, and an A.C. output determined by a ratio of a load impedance of the resonance circuit and the emitter feedback resistor $R_1$ is produced at a collector of a transistor $Q_1$.

As the thrown-in coin 7 approaches the detection coils or sensors 8 and 9, the load impedance of the resonance circuit changes depending on the conductivity of the coin 7, the permeability $\mu$ of the coin 7, the thickness $\tau$ of the coin 7 and the relative positions between the coin 7 and the detection coils 8 and 9, and the change appears as a change in the collector voltage of the transistor $Q_1$.

$C_3$ denotes a D.C. blocking coupling capacitor. The A.C. voltage output of the transistor $Q_1$ is supplied to a rectification circuit 13 through the coupling capacitor $C_3$ and a detection output is taken out as a D.C. voltage. $D_1$ and $D_2$ denote rectifying diodes, $C_4$ and $R_4$ denote a filtering capacitor and resistor, and $R_5$ and $C_5$ denote the resistor and capacitor of a low-pass filter, which bypasses a high frequency component of a steady oscillation frequency band of the oscillation circuit 12. Thus, the detection output free from a high frequency ripple noise is supplied to an A/D converter input terminal of a microcomputer 14. The pair of detection coils 8 and 9 are placed in grooves of pot-type ferrite cores 402A–402D as shown in FIGS. 2A and 2B with the coils 8*a*, 8*b*, 9*a* and 9*b* being embedded therein. In the present embodiment, the outer diameters of the detection coils 8 and 9 are smaller than a minimum diameter of true coins as shown in FIG. 4, and arranged in the coin paths 10 and 11 so that they are within the range of the diameter of the coin 7. Thus, the detection coils 8 and 9 are little influenced by the diameter of the true coin 7.

The detection coil 8 of FIG. 1 includes the coils 8*a* and 8*b* arranged opposingly to the coin paths 10 and 11 with a spacing of $d_3$ therebetween, as shown in FIG. 2A. Those coils are connected in series and in phase. Accordingly, a direction of magnetic fluxes created thereby is in a direction to penetrate into the coin 7 as shown by an arrow 410. Therefore, the magnetic fluxes change depending on the type of the coin 7 and the thickness and material of the coin can be detected.

The second detection coil 9 has coils 9a and 9b opposingly arranged to the coin paths 10 and 11 with the spacing $d_3$ therebetween as shown in FIG. 2B. Those coils are connected in series with opposite phases. Accordingly, a direction of magnetic fluxes created thereby is along the surface of the coin 7 as shown by an arrow 411. When the coin is placed in the influence of the electromagnetic field, the penetration factor of the magnetic fluxes into the coin is given by $d=1/\sqrt{wk\mu}$ ($w=2\pi f$). If the frequency f is very high or the conductivity k is very high, the current and flux density in the coin are not zero and the densities thereof are smaller as they go toward the center of the coin. If the oscillation frequency determined by the resonance circuit is appropriately selected, the first detection coil 8 has a high penetration factor and sensitively responds primarily to the material of the coin 7. The second detection coil 9 has the magnetic fluxes along the surface of the coin. Thus, it sensitively responds to a distance $d_1+d_2$ between the detection coil 9 and the coin 7 and hence responds to the thickness of the coin 7 $t=d_3-(d_1+d_2)$. Accordingly, the detection coil 9 detects the thickness of the coin.

In the present embodiment, the oscillation frequency of the oscillation circuit 12 is set to 115 KHz. The surface wave depth d in copper (Cu) which is frequently used for the coin is given below with a frequency being a parameter.

| | |
|---|---|
| $d_H \approx 0.05$ mm (f = 1000 KHz) | $k = \frac{1}{2} \times 10^{-8}$ (v/m) |
| $d_M \approx 0.15$ mm (f = 115 KHz) | $\mu = 4\pi \times 10^{-7}$ (H/m) |
| $d_L \approx 0.5$ mm (f = 10 KHz) | |

It has been known that the thickness of the coin can be determined accurately if the surface wave depth d meets a relationship of d/coin thickness<0.1. On the other hand, from the standpoint of the determination of the material of the coin, the surface wave depth d is preferably larger than the thickness of the coin and the oscillation frequency is preferably as low as possible. In the present embodiment, the detection coil 8 comprises the opposing sensors and the opposing coils 8a and 8b are connected in series and in phase so that the apparent surface wave depth d is large enough relative to the thickness of the coin in determining the material of the coin.

FIG. 3 shows a typical example of a waveform of a detection voltage developed at the A/D converter input terminal of the microcomputer 14 of FIG. 1, when the coin 7 passes by the detection coils 8 and 9.

The microcomputer 14 sequentially reads in the detection voltages from the A/D converter input terminal and detects an output voltage $E_0$ when the coin 7 does not exist in the coin paths 10 and 11 and voltages $V_{d1}$ (first bottom voltage), $V_{d2}$ (second bottom voltage), $V_{d3}$ (third bottom voltage), $V_{p1}$ (first peak voltage) and $V_{p2}$ (second peak voltage) at characteristic points of the change of the output voltage when the coin 7 passes through the coin paths 10 and 11. The microcomputer 14 also detects and stores time relationships of the characteristic points such as a time interval between $V_{d1}$ detection and $V_{d2}$ detection and a peak period $t_2$ of $V_{p1}$.

FIGS. 5A and 5B show detection voltages developed when a circular false coin 703 having a diameter equal to a minimum diameter of the true coins to be selected and a false coin 703 having a diameter equal to a maximum diameter of the true coins and having the same material and thickness as those of the false coin 703 are passed through the coin paths 10 and 11 in which the first detection coil 8 and the second detection coil 9 are arranged as shown in FIG. 4. A point 710 corresponds to the material of the coin and a point 711 corresponds to the thickness of the coin. In the present embodiment, the points 710 and 711 have no change because the coins 702 and 703 are of the same material and thickness. A detection output for the false coin 702 when a mutual action between the second detection coil 9 and the false coin is eliminated is shown by a curve 704, and a detection output for the false coin 703 is shown by a curve 706. The point 710 shows the voltage bottom point of the curves 704 and 706, a detection output for the false coin 702 when a mutual action between the first detection coil 8 and the false coin is eliminated is shown by a curve 705, and a detection output for the false coin 703 is shown by a curve 707. The point 711 shows a voltage bottom point of the curves 705 and 707.

A distance $D_s$ between the first detection coil 8 and the second detection coil 9 is selected such that the curve 704 does not affect to the bottom 711 of the curve 705 and the curve 705 does not affect to the bottom of the curve 704 when the true coin passes through the detection coils 8 and 9. Accordingly, a combined output of the curves 704 and 705 is represented by a curve 708, and a combined output of the curves 706 and 707 are represented by a curve 709.

A test output voltage $V_{p2s}$ of the combined test output curve 708 on a crossing time axis of the curves 704 and 705, and a test output voltage $V_{p2L}$ of the combined test output curve 709 on a crossing time axis of the curves 706 and 707 are different from each other due to a difference between areas of mutual actions between the coin and the detection coils 8 and 9, that is, a difference between the diameters of the coins. As a result, the voltage peak points 712 and 713 on the combined test output curves 708 and 709 sensitively respond to the diameter of the coin. By selecting the distance between the detection coils 8 and 9 to be smaller than the diameter of the smallest one of the coins to be selected, the material of the coin can be detected by the voltage $V_{p1}$ of the D.C. detection voltage curve of FIG. 3, the thickness of the coin is detected by the voltage $V_{d3}$ and the diameter of the coin is detected by the voltage $V_{p2}$.

The order of the arrangement of the first detection coil 8 and the second detection coil 9 along the flow of the coin may be reversed so long as the relative positional relationship of the detection coils 8 and 9 is held in the manner shown in FIG. 4A.

FIG. 4B shows an arrangement of the detection coils when a diameter detection coil is additionally used as a third detection coil.

FIGS. 5C and 5D show detection voltage curves developed when the false coins 702 and 703 are passed through the coin paths 10 and 11. A detection output by the detection coil 8 and the false coin 702 when the mutual action between the second and third detection coils 9 and 800 and the false coin is eliminated is shown by a curve 801, and a detection output by the false coin 703 is shown by a curve 804.

Similarly, a detection output by the detection coil 9 and the false coin 702 is shown by a curve 802, a detection output for the false coin 703 is shown by a curve 805, a detection output by the detection coil 800 and the false coin 702 is shown by a curve 803, and a detection output for the false coin 703 is shown by a curve 806.

In the present embodiment, the third detection coil 800 is used to detect the size of the coin. The distance between the first detection coil 8 and the second detection coil 9 is selected such that, when the true coin passes therethrough, the curve 801 does not affect to the voltage bottom point 810 of the curve 802 and the curve 802 does not affect to the voltage bottom point 809 of the curve 801. It need not be smaller than the minimum diameter of the true coin.

On the other hand, the distance $D_{s2}$ between the second detection coil 9 and the third detection coil 800 is selected to meet a similar relationship to the distance $D_s$ between the first and second detection coils 8 and 9. The level of the third detection coil 800 from the ramp 3 is selected as shown in FIG. 4B so that the third detection coil 800 is largely affected by the diameter of the coin 7. As a result, the area opposing the third detection coil 800 changes with the size of the coin and the voltage bottom points 811 and 812 on the curves 807 and 808 sensitively respond to the diameter of the coin.

The third detection coil 800 preferably has opposing sensors like the second detection coil 9 and the coils are connected in series and opposite phases so that the affect by the material to the detection output is reduced. Depending on the selection accurracy required by the coin selection apparatus, the third detection coil 800 may not have opposing sensors.

Figure 6A:
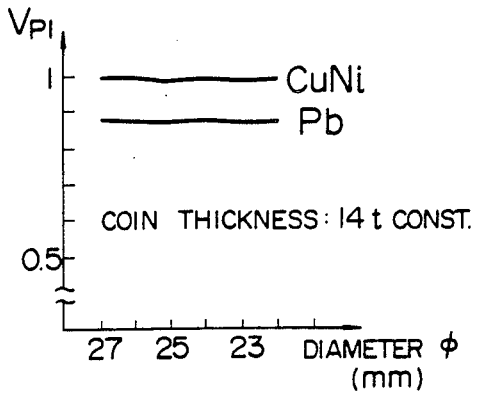
FIGS. 6A to 6C show output characteristics of the detection circuits.
Figure 6B:
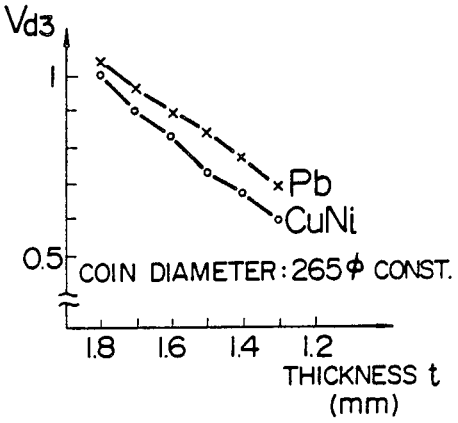
Figure 6C:
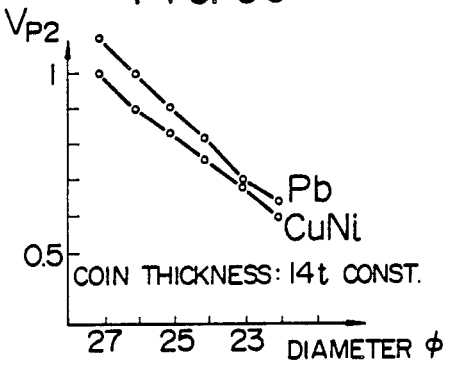

FIGS. 6A to 6C show characteristic curves derived from detection outputs when circular false coins of white copper ($C_uN_i$) and lead ($P_b$) are passed through the coin paths 10 and 11, with an abscissa representing a diameter $\phi$ or a thickness t and an ordinate representing voltage $V_{p1}$, $V_{d3}$ or $V_{p2}$. The voltage $V_{p1}$ primarily responds to the material of the coin 7, $V_{d3}$ primarily responds to the thickness t of the coin 7 and $V_{p2}$ primarily responds to the diameter $\phi$ of the coin 7.

Figure 7:
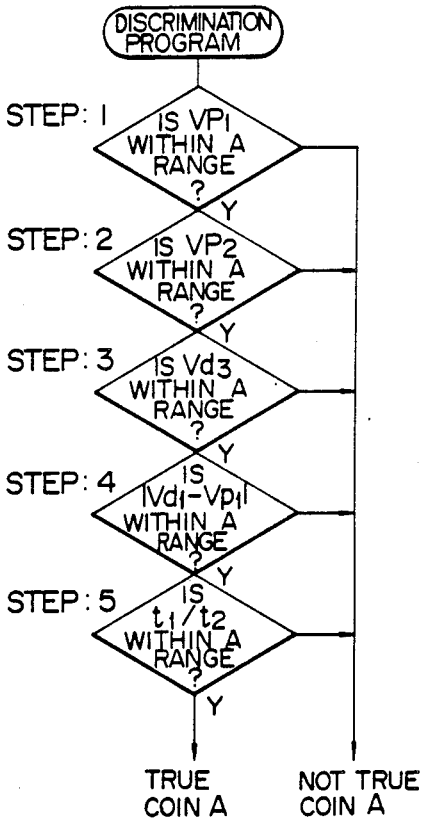
FIG. 7 shows a coin selection program flow.
Figure 8:
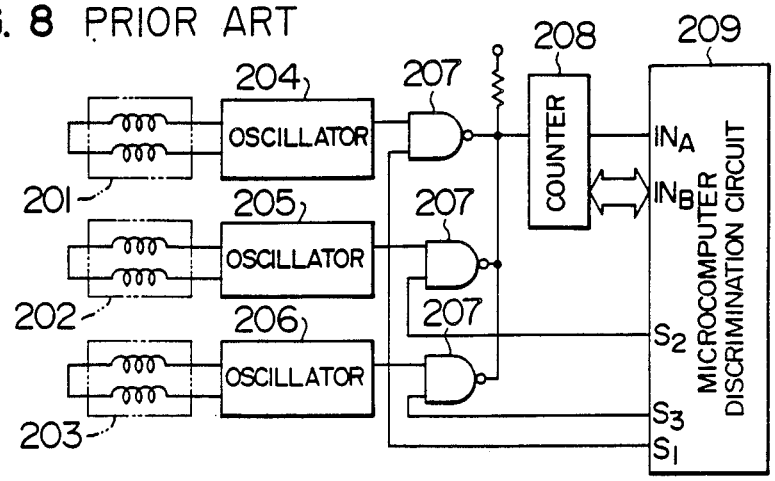
FIG. 8 PRIOR ART
FIGS. 8, 9 and 10 are circuit diagrams of prior art coin selection apparatus.
Figure 9:
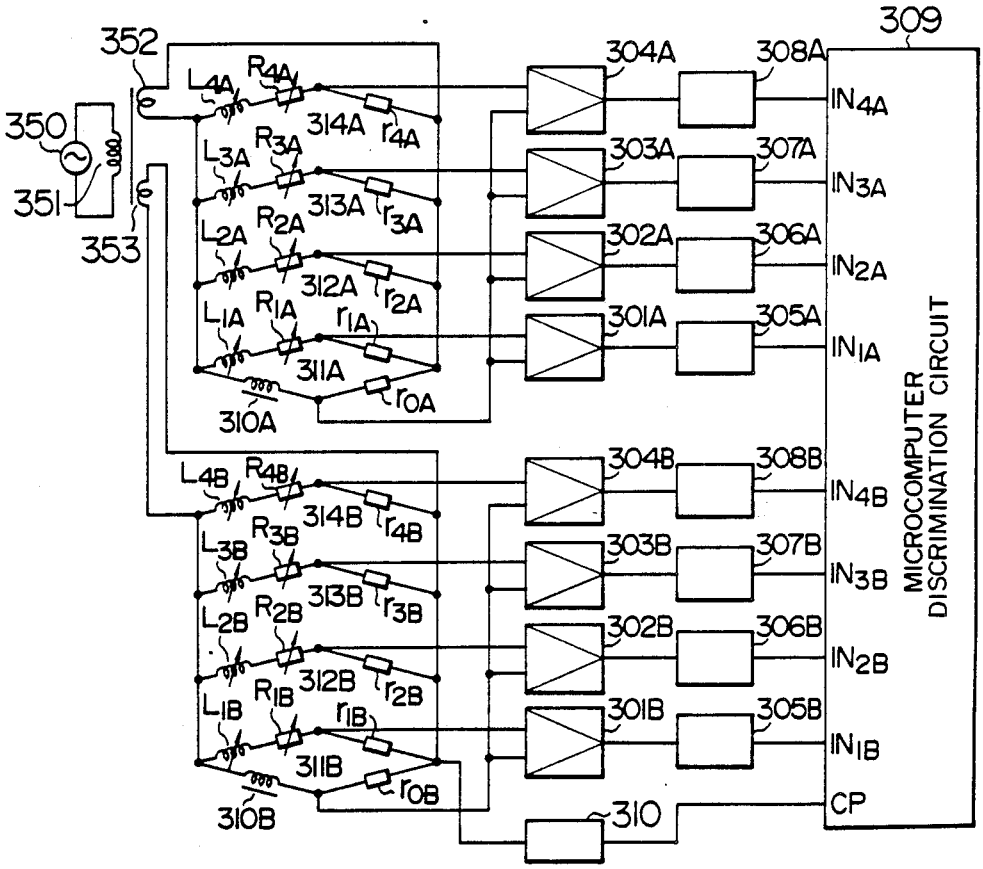
FIG. 9 PRIOR ART
Figure 10:
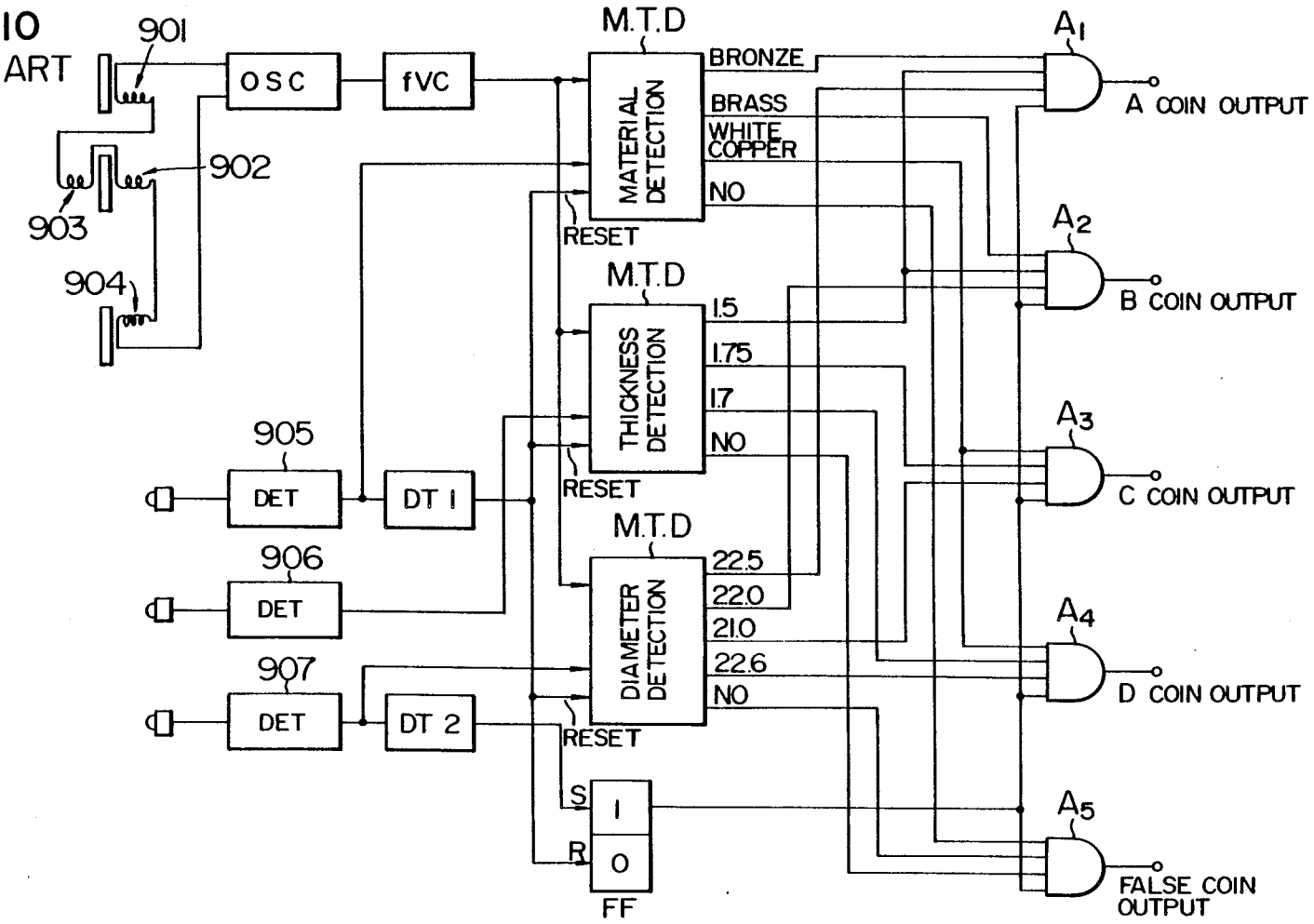
FIG. 10 PRIOR ART

FIG. 7 shows a compare/discrimination program in the microcomputer 14 of FIG. 1B.

In steps 1-3, whether $V_{p1}$, $V_{p2}$ and $D_{d3}$ are within predetermined ranges or not is determined to discriminate the material, diameter and thickness of the coin.

In order to enhance the rejection ability for the false coin and the discrimination ability for a true coin, the mutual relationship between the levels at the peak and bottom points of the detection output waveform shown in FIG. 3 and the time is determined in steps 4 and 5. In the step 4, an absolute value of a difference between $V_{d1}$ and $V_{p1}$ is compared with a predetermined range for each true coin. Assuming that there are a coin A and a coin B having the same material and thickness as the coin A and a larger diameter than the coin A, the present embodiment is effective to reject a false coin for the coin B which is manufactured by applying a ring of different material to the coin A.

Even if the false coin is manufactured with the same material of the same diameter and thickness, if the coin has a center hole, relative difference between the peak and bottom points such as $|V_{d1}-V_{p1}|$ or $|V_{p1}-V_{d2}|$, or a ratio of the time interval $t_1$ between $V_{d1}$ and $V_{d2}$ and a time period $t_2$ of $V_p$ are different from those of the true coin. Accordingly, those features are checked for each type of coin.

Those differences between the true coin and the false coin could not be detected in the prior art apparatus. In the present embodiment, those differences are checked in combination to attain accurate discrimination of the true coin.

In accordance with the present invention, two sets of detection coils each having two coils opposingly arranged in a predetermined spaced relationship along a coin path along which a coin is slid, and one detection circuit detect the three factors of the coin (diameter, material and thickness) and the appearance difference from a reference coin (for example, presence or absence of a center hole). Accordingly, the coin can be accurately selected with a very simple arrangement and a small number of components. Thus, the serviciability is enhanced. The present invention can satisfy the requirement for the compactness in the coin changer and the automatic vending machine which incorporate the coin selection apparatus.

We claim:

1. A coin selection apparatus comprising:

a coin path along which a coin is fed;

at least two coin sensors arranged along said path and having impedances which are changeable with the passage of a coin therealong;

a detection circuit means for detecting impedance changes of said coin sensors; and a discrimination circuit means, connected to said detection circuit means, for discriminating coin characteristics on the basis of the detected impedances of said coin sensors; and wherein each of said two coin sensors comprises two coils opposingly arranged to said coin path, one of said two coin sensors has its two coils connected in series in phase principally for the discrimination of coin material, the other of said two coin sensors has its two coils connected in series in phase opposition principally for the discrimination of coin thickness, said coin sensors are connected in series, and said one and said other coin sensors have a defined spacing therebetween along said coin path principally for the discrimination of coin diameter, with said spacing being smaller than a diameter of the smallest one of the coins to be selected.

2. A coin selection apparatus according to claim 1, wherein: said detection circuit means includes a resonance circuit including said series connected coin sensors, an oscillation circuit for generating a change of an oscillation voltage according to a change of an impedance of said resonance circuit, and a rectification circuit for converting the change of the oscillation voltage into a change of a D.C. voltage; and said discrimination circuit includes means for measuring and storing data of the voltage levels of the peak and bottom of the change of the D.C. voltage from said detection circuit, means for comparing the voltage levels at the peak and bottom points with a respective reference level for the coin to be selected, and means for discriminating the material, thickness and diameter of the coin on the basis of the compared results.

3. An apparatus according to claim 2, wherein: said data measuring and storing means measures and stores data of one voltage level and its generation timing at one peak point or bottom point and of another voltage level and its generation timing at another peak point or bottom point; said voltage level comparing means includes first means for comparing a relative ratio or relative difference of said one and another voltage levels with a respective reference level for the coin to be selected, and second means for comparing a ratio of the duration periods across said one and another voltage levels with a reference ratio for the coin to be selected; and said discrimination means further includes means for discriminating false coin characteristics other than diameter, material and thickness on the basis of at least one of the compared results of said first and second means.

4. A coin selection apparatus comprising:

a coin path along which a coin is fed;

detection coils arranged along said coin path and having impedances changeable with passage of a coin therealong;

a detection circuit comprising a resonance circuit including said detection coils, an oscillation circuit for generating a change of an oscillation voltage according to a change of an impedance of said resonance circuit, and a rectification circuit for converting the change of the oscillation voltage into a change of a D.C. voltage;

a discrimination circuit comprising means for measuring and storing data of voltage levels of the peak and bottom of the change of the D.C. voltage supplied from said detection circuit, means for comparing the peak and bottom voltage levels with respective reference levels for the coin to be selected, and means for discriminating material, thickness and diameter of the coin on the basis of the compared results; and wherein each of said detection coils comprises two coil segments opposingly arranged to said coin path with a first of said detection coils having its two coil segments connected in series and in phase principally for the discrimination of coin material, with a second of said detection coils having its two coil segments connected in series and in phase opposition principally for the discrimination of coin thickness, with all of said detection coils inclusive of said first and second detection coils being connected in series, and with said first and second detection coils being spaced along said path and defining therebetween a spacing smaller than a diameter of the smallest coin to selected for the discrimination of coin diameter.

5. An apparatus according to claim 4, wherein: said data measuring and storing means measures and stores data of one voltage level and its generation timing at one peak point or bottom point and of another voltage level and its generation timing at another peak point or bottom point; said voltage level comparing means includes first means for comparing a relative ratio or relative difference of said one and another voltage levels with a respective reference level for the coin to be selected, and second means for comparing a ratio of duration periods across said one and another voltage levels with a reference ratio for the coin to be selected; and said discrimination means further includes means for discriminating false coin characteristics other than diameter, material and thickness on the basis of at least one of the compared results of said first and second means.

6. A coin selection apparatus comprising:

a coin path along which a coin is fed;

a plurality of detection coils arranged along said coin path and having impedances changable with passage of a coin therealong;

a detection circuit means for detecting changes of impedances of said detection coils; and a discrimination circuit means, connected to said detection circuit means, for measuring and storing data of the peak and bottom points of the impedance changes of said detection coils, for comparing the stored data at the peak and bottom points with respective reference values predetermined for the objective true coins to be selected, and for discriminating the material, thickness and diameter of the coin passing along said path on the basis of the compared results; and wherein said plurality of detection coils include at least two sets of detection coils each having two coils opposingly arranged to said coin path so that a coin passes between the coils of a set, all of said detection coils including said opposingly arranged coils are connected in series and to said detection circuit means, one of said sets of detection coils has its two coils connected in series and in phase principally for the discrimination of coin material and the other of said sets of detection coils has its two coils connected in series with opposite phases principally for the discrimination of coin thickness, and said one set of detection coils and said other set of detection coil are spaced along said coin path by a distance which is smaller than a diameter of a smallest one of the true coins to be selected principally for the discrimination of coin diameter.

7. An apparatus according to above claim 6, wherein said discrimination circuit means furthcr includes:

means for measuring and storing data of the generation timings of the peak and bottom points of impedance changes of said detection coils to measure and store data of a peak-to-peak duration period and a bottom-to-bottom duration period;

first means for comparing a relative ratio or relative difference of one and another peak or bottom point with a respective reference level predetermined for the objective true coin;

second means for comparing a ratio of said duration periods with a reference ratio predetermined for the true coin; and means for discriminating coin characteristics other than diameter, material and thickness on the basis of at least one of the compared results of said first and second means.

* * * * *